US006200056B1

(12) United States Patent
Jordin et al.

(10) Patent No.: US 6,200,056 B1
(45) Date of Patent: Mar. 13, 2001

(54) ATTACHMENT APPARATUS FOR SECURING AN ELECTRONIC DEVICE TO A LOOSE-LEAF SUPPORT ASSEMBLY, ASSEMBLIES INCLUDING SAME, AND METHODS

(75) Inventors: Cherell Jordin, Draper; Gary E. Hogge, Kaysville; Jeffery O. Brown, North Logan, all of UT (US)

(73) Assignee: Franklin Covey Co., Salt Lake City, UT (US)

( * ) Notice: Subject to any disclaimer, the term of this patent is extended or adjusted under 35 U.S.C. 154(b) by 0 days.

(21) Appl. No.: 09/307,148

(22) Filed: May 7, 1999

(51) Int. Cl.[7] ..... B42F 13/40

(52) U.S. Cl. ..... 402/4; 281/38; 402/70; 402/502

(58) Field of Search ..... 281/38, 51; 402/4, 402/70, 79, 502

(56) References Cited

U.S. PATENT DOCUMENTS

| | | | | |
|---|---|---|---|---|
| D. 343,187 | | 1/1994 | Webb et al. . | |
| D. 345,757 | | 4/1994 | Webb et al. . | |
| 4,832,191 | | 5/1989 | Gerver et al. . | |
| 4,918,632 | | 4/1990 | York . | |
| 5,058,736 | * | 10/1991 | Bedol | 402/4 |
| 5,209,592 | | 5/1993 | Bedol . | |
| 5,219,239 | * | 6/1993 | Bianco | 402/79 |
| 5,232,301 | | 8/1993 | Bianco . | |
| 5,388,306 | * | 2/1995 | Bedol | 402/4 |
| 5,409,319 | * | 4/1995 | Bedol | 402/4 |
| 5,597,256 | * | 1/1997 | Burton et al. | 402/4 |
| 5,678,943 | * | 10/1997 | Parsons | 402/4 |
| 5,867,144 | * | 3/1999 | Bedol et al. | 402/4 |
| 6,004,060 | * | 12/1999 | Bedol | 402/4 |

* cited by examiner

*Primary Examiner*—A. L. Wellington
*Assistant Examiner*—Monica S. Carter
(74) *Attorney, Agent, or Firm*—Trask Britt

(57) ABSTRACT

An apparatus for attaching an electronic device to one or more of the retaining elements of a loose-leaf support assembly. The attachment apparatus includes a securing element and an attachment element. The securing element mutually engages a corresponding feature of the electronic device, such as a slotted recess proximate, adjacent, or in a peripheral edge of the electronic device. The attachment element includes apertures to facilitate the loose attachment of the attachment apparatus to the retaining elements of a loose-leaf support assembly.

25 Claims, 6 Drawing Sheets

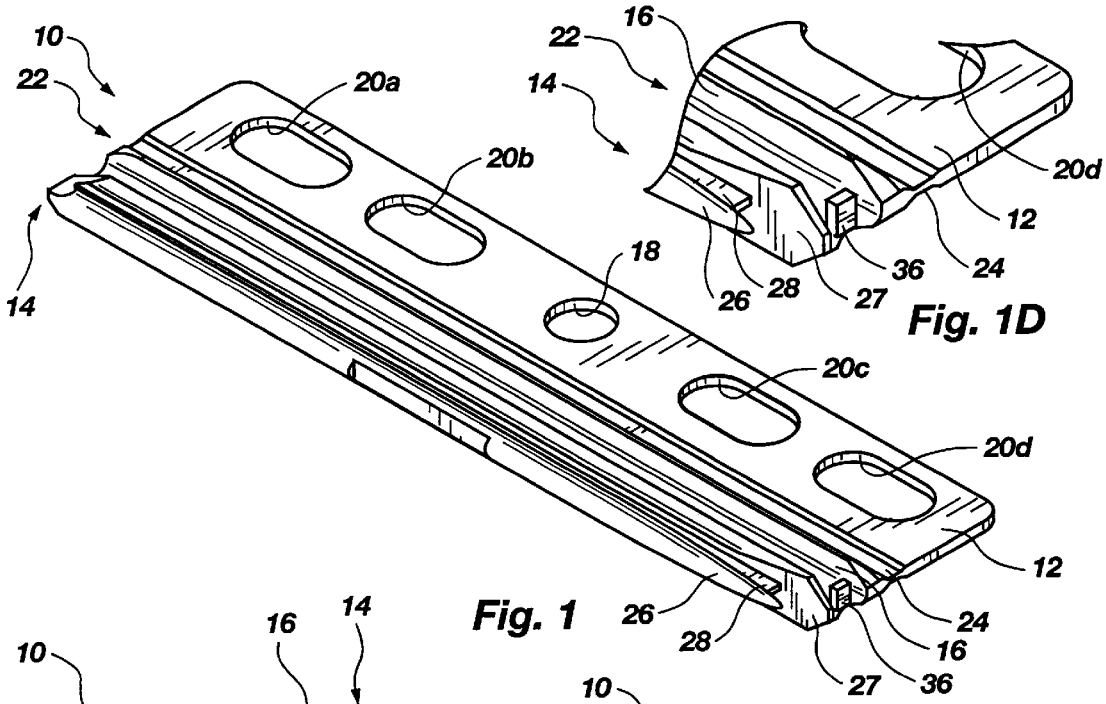
Fig. 1D
Fig. 1
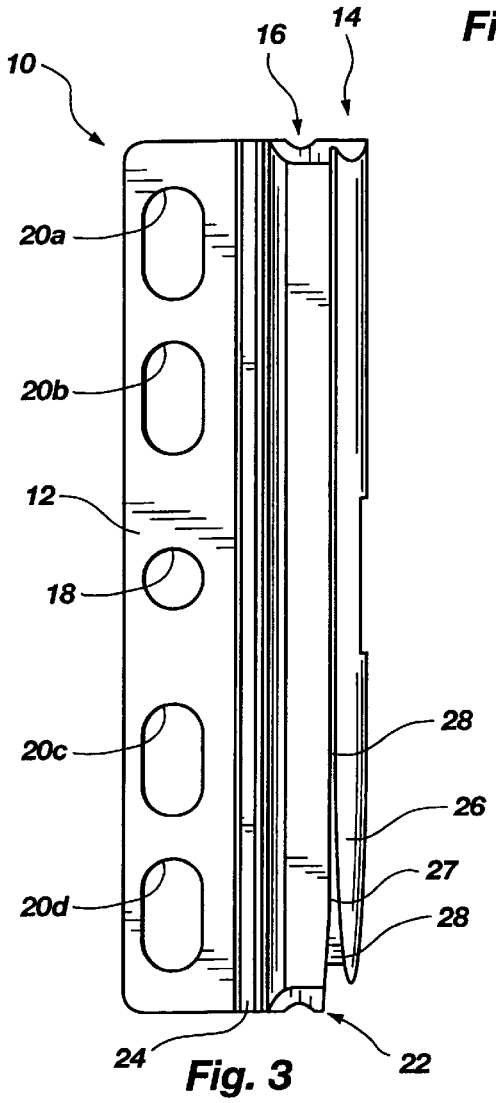
Fig. 3
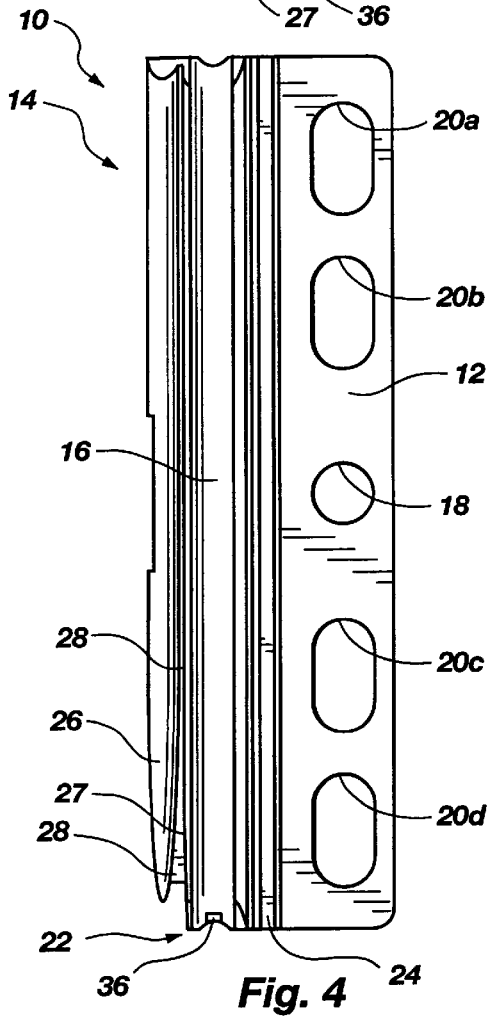
Fig. 4

ATTACHMENT APPARATUS FOR SECURING AN ELECTRONIC DEVICE TO A LOOSE-LEAF SUPPORT ASSEMBLY, ASSEMBLIES INCLUDING SAME, AND METHODS

BACKGROUND OF THE INVENTION

1. Field of the Invention

The present invention relates to apparatus for securing electronic devices into notebooks. Particularly, the present invention relates to apparatus for releasably securing a hand-held or portable electronic device to the rings of a loose-leaf support assembly, such as a binder-type notebook. More specifically, the present invention relates to apparatus for securing an electronic device within the notebook of a time management or other planning-type organizer system.

2. Background of Related Art

Due to the ever-decreasing size of electronic devices and the ever-increasing use of notebooks which include time management or other planning systems, various apparatus have been developed to make small electronic devices, such as calculators, readily accessible to the users of such notebooks, and in conjunction with information contained within the notebook.

Some of these apparatus secure a calculator to the rings of binder-type notebooks. These apparatus typically include integral calculators and small, circular apertures disposed along an edge thereof to facilitate securing of the apparatus to the rings of a binder. Since the calculators are an integral part of each of these apparatus, they may not be removed therefrom. Thus, unless the calculator is removed from the rings of the binder, the calculator cannot be accessed concurrently with information from any pages of the notebook that are not adjacent to the calculator. Moreover, such apparatus may not be employed to secure more than one type of electronic device to a notebook. The small, circular apertures of these apparatus are also somewhat undesirable, as they may only be used in a specific type of notebook having a specific number of rings that are laterally spaced apart discrete distances from one another. Apparatus exemplary of this configuration are disclosed in U.S. Pat. No. Des. 345,757 ("the '757 Patent"), which issued to Webb et al. on Apr. 5, 1994; U.S. Pat. No. Des. 343,187 ("the '187 Patent"), which issued to Webb et al. on Jan. 11, 1994; and U.S. Pat. No. 5,209,592 ("the '592 Patent"), which issued to Bedol on May 11, 1993.

U.S. Pat. No. 4,918,632 ("the '632 Patent"), which issued to York on Apr. 17, 1990, discloses a notebook-type computer that includes a housing that may be secured to the rings of a binder-type notebook. As with the calculators discussed above, the computer is integrated within the housing. Thus, the housing may not be used to secure other electronic devices to the rings of a binder-type notebook. The housing also includes small, circular apertures along the top of the computer for securing the electronic device to the rings of a binder-type notebook. Thus, as with the aforementioned calculators, the housing may only be secured to notebooks of a limited size and having a limited number of rings which are laterally-spaced, discrete distances from one another.

An apparatus that may be employed to secure a variety of hand-held electronic devices within a variety of binder-type notebooks is disclosed in U.S. Pat. No. 5,597,256 ("the '256 Patent"), which issued to Burton et al. on Jan. 28, 1997. The apparatus of the '256 Patent is an insert that includes a flat member to which a hand-held electronic device, such as a calculator, may be secured by attaching one member of complementary hook and loop materials to the flat member, and the other hook or loop material member to the back of the electronic device. The use of hook and loop materials to secure the electronic device to the flat member is, however, somewhat undesirable since, over time, the hook material tends to gather lint, which may reduce the affinity of the hook and loop materials for one another. Moreover, the mutual affinity with which the hook and loop materials secure the electronic device to the flat member may not be adequate to retain the electronic device on the flat member if the notebook that holds the insert is dropped.

Other inserts for securing hand-held electronic devices into binder-type notebooks are marketed by Franklin Covey Co., the assignee of the invention disclosed herein. These inserts are configured to capture or retain the peripheries or features on the peripheries of the hand-held electronic devices disposable in the receptacles of these inserts. When an electronic device is secured within the receptacle of one of these inserts, the insert surrounds the periphery of the electronic device in order to capture or retain the electronic device. Thus, these devices have somewhat larger dimensions than the electronic devices to be secured thereto and, therefore, may be relatively bulky with respect to the electronic devices to be secured thereto, making the use of these inserts in a binder somewhat undesirable. Moreover, each of these inserts, as marketed, is configured to receive electronic devices having specific shapes and/or a narrow range of height, width, and thickness dimensions.

Other apparatus secure calculators or other electronic devices to the rigid cover of a notebook or any other book by means of mounts, sleeves, or clamps. An exemplary apparatus of this type is disclosed in U.S. Pat. No. 4,832,191 ("the '191 Patent"), which issued to Gerver et al. on May 23, 1989. The apparatus of the '191 Patent includes a sleeve that envelops a substantial portion of the rigid cover. A flap, which holds and exposes the display and keys of a calculator, is hingedly attached to the sleeve. The design of the device of the '191 Patent is somewhat undesirable, however, in that the sleeve may slide along the rigid cover of the notebook and may, therefore, not adequately secure the calculator to the cover of the notebook. The sleeve may be further undesirable from an aesthetic standpoint, since it is exposed on the exterior of the rigid cover of a notebook or other book.

U.S. Pat. No. 5,232,301 ("the '301 Patent"), which issued to Bianco on Aug. 3, 1993, discloses a binder which includes an apparatus for securing an electronic device, such as a calculator, thereto. The apparatus is permanently secured to the cover of the binder by a mounting bracket. A frame, which is secured to the mounting bracket by a hinge, is rotatably mounted to a slipcase, in which the electronic device may be removably disposed. This arrangement facilitates use of the calculator while the binder is closed or open, as well as use of the calculator while accessing pages that are bound to the rings of the binder. The design of the apparatus of the '301 Patent is somewhat undesirable, however, in that the electronic device must be removed therefrom in order to communicate with any external devices, such as printers, computers, or other electronic devices. Moreover, the mounting bracket of the mechanism of the '301 Patent is partially exposed to the exterior of the binder cover, making it somewhat undesirable from an aesthetic standpoint. Furthermore, since the apparatus is permanently mounted to the binder, it may not be removed from the binder when removal is desired. Nor may the apparatus be used in conjunction with another notebook.

Thus, an apparatus is needed for removably attaching an electronic device to the retaining elements of loose-leaf support assemblies in a manner that securely, yet removably retains the electronic device, which apparatus is itself removable form the support assembly, and which does not consume a significantly greater amount of space within the support assembly than the amount of space consumed by the electronic device secured thereto. An apparatus is also needed which enables attachment of electronic devices to a variety of support assemblies that have different numbers of retaining elements or to a variety of different support assemblies of which the retaining elements are laterally spaced apart different distances from one another. There is also a need for an apparatus that facilitates communication between an electronic device secured thereto and external equipment as the electronic device is attached to a support assembly.

SUMMARY OF THE INVENTION

The present invention includes an apparatus for securing an electronic device to a loose-leaf retaining element, which is also referred to herein simply as a retaining element, such as one or more of the rings of a loose-leaf type support assembly (e.g., a loose-leaf binder). The apparatus of the present invention is also referred to herein as an attachment apparatus. The attachment apparatus of the present invention includes an attachment element, by which the apparatus may be removably attached to a loose-leaf support assembly by means of the retaining element. A securing element, disposed adjacent the attachment element, is configured to be secured to a complementarily configured feature of the electronic device, such as a slotted receptacle proximate a peripheral edge of the electronic device.

The attachment element is preferably an elongate member including one or more apertures defined therethrough. The aperture or apertures are configured and positioned on the attachment element so as to facilitate loose-leaf type attachment, or loose attachment, of the attachment element to loose-leaf support assemblies including one or more types of retaining elements, different numbers of retaining elements, and retaining elements that are spaced apart different distances from one another.

An engaging member of the securing element, which may also be referred to herein as a post, is configured to engage or to be engaged by a corresponding, complementary feature of the electronic device. Alternatively, the engaging member and the corresponding feature of the electronic device may mutually engage one another.

In a preferred embodiment of the attachment apparatus of the present invention, the engaging member is secured to the adjacent, substantially mutually parallel attachment element by means of a connecting member. An exemplary connecting member includes a so-called "living" hinge, or elongate, thinned region of the apparatus. The connecting member is also preferably oriented substantially parallel to the attachment element and the engaging member. Preferably, the engaging member, connecting member, and attachment element are formed of a single piece of material (i.e., these features are integral with one another). The region of the connecting member adjacent the engaging member may be thinner than the engaging member so as to facilitate insertion of the attachment apparatus into a slotted recess of the electronic device, preferably proximate or adjacent a peripheral edge of the electronic device. The connecting member may comprise one or more segments that extend only partially along the lengths of either the engaging member or the attachment element. Alternatively, the connecting member may extend along the substantial length of one or both of the engaging member and the attachment element.

Preferably, the engaging member has an elongate, substantially cylindrical shape. Accordingly, an electronic device that may be secured to this embodiment of the attachment apparatus may have a complementarily, elongate, substantially cylindrically shaped receptacle adjacent, proximate, or in a side thereof. The preferably thin region of the connecting member adjacent the engaging member extends through a slot continuous with the receptacle of the electronic device. Of course, engaging members and their corresponding electronic device receptacles may have other shapes, such as elongate members having quadrilateral (e.g., square), triangular, oval, or other shapes of cross sections, as well as other shapes of engaging members, including, without limitation, spherical, hemispherical, conical, frustoconical, etc., are also within the scope of the present invention.

Alternatively, the engaging member of the attachment apparatus of the present invention may include a receptacle within which a complementarily configured feature of the electronic device may be secured. As another alternative, one of the attachment apparatus and the electronic device may include another type of engaging member, such as a clamp, to secure to the other.

The attachment apparatus of the present invention may also include an accessory receptacle for receiving an accessory of the electronic device, such as a so-called "stylus pen" or a hinge of a protective cover of the electronic device. Preferably, such an accessory receptacle is disposed on or adjacent the connecting member of the engaging element of the inventive attachment apparatus. Alternatively, the accessory receptacle may be disposed between the connecting member and the attachment element or on the attachment element.

The present invention also includes an assembly of the electronic device and the inventive attachment apparatus, as well as an assembly of the electronic device, the inventive attachment apparatus, and a loose-leaf support assembly.

Methods of securing an electronic device to an attachment apparatus that is removably attachable to a retaining element of a loose-leaf support assembly and of securing an electronic device to a retaining element of a loose-leaf support assembly are also within the scope of the present invention. In the methods of the present invention, complementarily configured features of the electronic device and the inventive attachment apparatus may be interconnected, mutually engaged, or otherwise secured to one another. The attachment element of the inventive attachment apparatus may then be removably attached to a loose-leaf support assembly by means of one or more retaining elements thereof.

Other features and advantages of the present invention will become apparent to those of ordinary skill in the art through a consideration of the ensuing description, the accompanying drawings, and the appended claims.

BRIEF DESCRIPTION OF THE SEVERAL VIEWS OF THE DRAWINGS

FIG. 1 is a frontal perspective view of an attachment apparatus for removably attaching an electronic device to a loose-leaf support assembly;

FIG. 1D is an enlarged partial perspective view of the attachment apparatus shown in FIG. 1;

FIG. 3 is a plan view of a back of the attachment apparatus shown in FIG. 1;

FIG. 4 is a plan view of a front of the attachment apparatus shown in FIG. 1;

DETAILED DESCRIPTION OF THE INVENTION

Figure 1A:
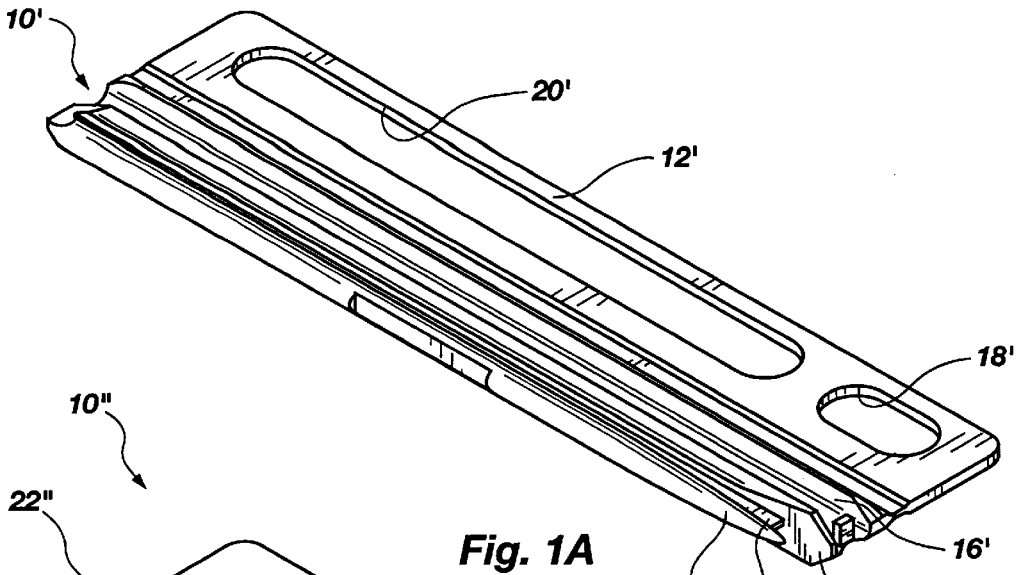
FIG. 1A is a frontal perspective view of a second embodiment of the attachment apparatus of the present invention, depicting a variation of the securing element thereof.

With reference to FIGS. 1, 1D, 2, and 9, an attachment apparatus 10 is shown. Attachment apparatus 10 is securable to an electronic device 100, such as the hand-held or portable electronic device marketed under the trade name PALM V and manufactured by Palm Computing of Mountain View, Calif. Attachment apparatus 10 is configured to be removably attached to a retaining element 210 (see FIG. 9) of a loose-leaf support assembly 200 (see FIG. 9), which is also referred to simply as a support assembly. Of course, attachment apparatus 10 may also be adapted or configured to be secured to other electronic devices and to removably attach these other electronic devices to one or more of the retaining elements of a loose-leaf support assembly. Alternative embodiments of the attachment apparatus of the present invention may be configured to secure other hand-held or portable electronic devices, such as those manufactured by Palm Computing of Mountain View, Calif., and marketed under the trade names PALM PERSONAL, PALM PROFESSIONAL, and PALM III, to a retaining element of a support assembly.

Referring now to FIGS. 1, 1D, and 3–8, Attachment apparatus 10 includes an attachment element 12 and an securing member 14, which is also referred to herein as a securing element, adjacent attachment element 12. Attachment apparatus 10 may also include an accessory receptacle 16 disposed on securing member 14. Alternatively, an accessory receptacle may be disposed between securing member 14 and attachment element 12 or on attachment element 12.

Attachment element 12 may include a central aperture 18 and one or more secondary apertures 20*a*, 20*b*, etc. therethrough. Central aperture 18 preferably has a substantially circular shape so as to prevent lateral movement of attachment apparatus 10 relative to the retaining element or retaining elements and relative to the support assembly to which attachment apparatus 10 is removably attached. Secondary apertures 20*a*, 20*b*, etc. may comprise elongated slots or have substantially circular shapes. The apertures 18, 20*a*, 20*b*, etc. of attachment element 12 are preferably aligned such that the centers or longitudinal axes of apertures 18, 20*a*, 20*b*, etc. are aligned in a substantially linear relationship. Preferably, apertures 18, 20*a*, 20*b*, etc., are sized and spaced apart in a manner that facilitates the loose-leaf type attachment of attachment element 12 to a support assembly 200 (see FIG. 9) having a desired configuration of retaining elements 210.

Attachment element 12 may be configured to be removably attached to more than one configuration of retaining element if each secondary aperture 20*a*, 20*b*, etc. comprises an elongated slot. For example, the attachment element 12 of the attachment apparatus 10 illustrated in FIGS. 1, 1D, and 3–9 may be secured to loose-leaf support assemblies to which 8½×11 inch paper, "executive" paper (i.e., about 7¼×10½ inch), and other sizes of loose-leaf paper may be secured. The illustrated embodiment of attachment element 12 may also secure to as many as five retaining elements of such a support assembly.

FIG. 1A illustrates another embodiment of attachment apparatus 10', which includes a variation of the attachment element 12'. Attachment element 12' includes a first aperture 18' which is preferably substantially circular in shape, and at least one second aperture 20', which is elongated, adjacent to first aperture 18'. First aperture 18' is configured to removably attach to a retaining element while restricting lateral movement of attachment apparatus 10' relative to the retaining element. Second aperture 20' is configured to removably attach attachment apparatus 10' to one or more other retaining elements, thereby preventing pivotal movement of attachment apparatus 10' around the retaining element received by aperture 18'. Thus, first aperture 18' and second aperture 20' facilitate the securing of attachment apparatus 10' to a variety of support assemblies with different numbers of retaining elements and to retaining elements which are laterally spaced different distances from one another. Other variations of the attachment member, as well as variations of the apertures thereof, such as the variations disclosed in U.S. Pat. No. 5,597,256, which issued to Burton et al. on Jan. 28, 1997, the disclosure of which is hereby incorporated in its entirety by this reference, may also be employed with the attachment apparatus of the present invention.

Referring again to FIGS. 1, 1D, and 3–8, securing element 14 of attachment apparatus 10 includes a connecting member 22 preferably disposed adjacent attachment element 12. Connecting member 22 is preferably continuous with or secured to attachment element 12 and may extend the substantial length of attachment element 12. Connecting member 22 may include a so-called living hinge 24 adjacent attachment element 12 to impart attachment apparatus 10 with flexibility and resilience. Living hinge 24 may, therefore, reduce the likelihood that attachment apparatus 10 will be broken or otherwise damaged as the retaining elements of a loose-leaf support assembly to which attachment apparatus 10 are removably attached are moved through their corresponding apertures 18, 20*a*, 20*b*, etc. in order to change a position of the electronic device to gain access to a page or another object that is also secured to the retaining elements of the loose-leaf support assembly.

Securing element 14 also includes an engaging member 26, which is also referred to herein as a post. As illustrated in FIGS. 1, 1D, and 3–8, engaging member 26 has a substantially cylindrical shape and a cross-sectional thickness that is greater than the cross-sectional thickness of the adjacent region 28 of connecting member 22. As shown in FIG. 2A, engaging member 26 is configured complementarily to a corresponding receptacle 110 of the electronic device 100 to which attachment apparatus 10 is securable. As the illustrated attachment apparatus 10 is configured to be secured to a slotted accessory receptacle 110 adjacent a peripheral edge of an electronic device 100, such as the PALM V (see FIGS. 2 and 2A), engaging member 26 is preferably configured similarly to an accessory that may be received by the accessory receptacle, such as a stylus pen or the hinge of a protective cover for the electronic device. Region 28 of connecting member 22 is configured to be at least partially received within a corresponding slot 112 continuous with receptacle 110 of electronic device 100 (see FIGS. 2 and 2A).

Although engaging member 26 is depicted as having a substantially circular cross-section, variations of engaging member 26 may include any cross-sectional shape or even a varying cross-sectional shape that will facilitate the retention of engaging member 26 within receptacle 110. Exemplary cross-sectional shapes of engaging member 26 include, without limitation, quadrilaterals (e.g., square), ovals, ellipsoids, triangles, and other shapes.

Figure 5:
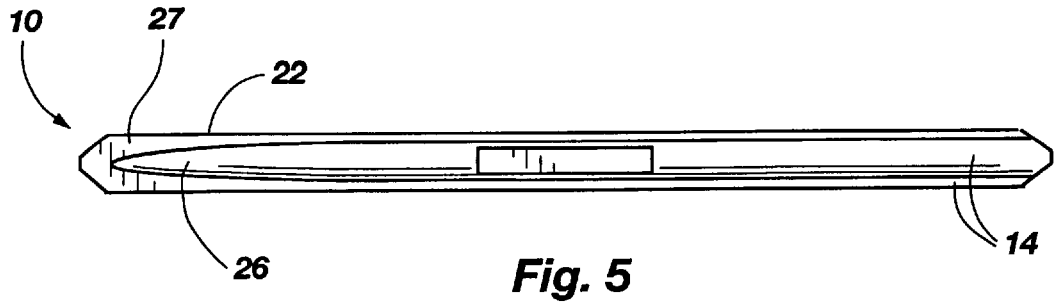
FIG. 5 is an elevational plan view of a first peripheral edge of the attachment apparatus shown in FIG. 1.
Figure 6:
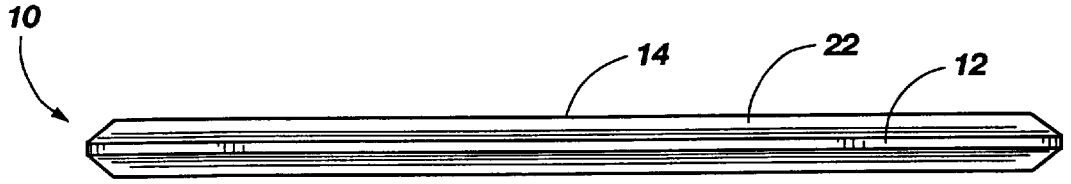
FIG. 6 is an elevational plan view of a second peripheral edge of the attachment apparatus shown in FIG. 1.

With reference to FIGS. 3–5, securing element 14 may include a device abutment surface 27 extending from one or both of the top or bottom surfaces of securing element 14, adjacent and facing in the general direction of engaging member 26. As device abutment surface 27 may abut a peripheral edge 111 (see FIG. 2A) or another corresponding region of the surface of an electronic device upon securing of engaging member 26 thereto, device abutment surface 27 is preferably configured to receive the corresponding region of the surface of the electronic device. Thus, device abutment surface 27 may impart attachment apparatus 10 with desired aesthetic characteristics. Device abutment surface 27 may also enhance that stability with which attachment apparatus 10 is secured to an electronic device.

Engaging member 26 may also include one or more protrusions 30, or dedents, nodules, bumps, or ribs, which are configured to engage correspondingly configured and positioned indents 114 (see FIG. 2A) within receptacle 110 of electronic device 100. These protrusions 30 may be configured to somewhat resiliently mutually engage their corresponding indents 114, thereby securing engaging member 26 within receptacle 110 and preventing longitudinal movement of engaging member 26 relative to receptacle 110 as attachment apparatus 10 and electronic device 100 are assembled. Alternatively, receptacle 110 may include protrusions while engaging member 26 includes corresponding, complementarily configured indents.

Figure 1B:
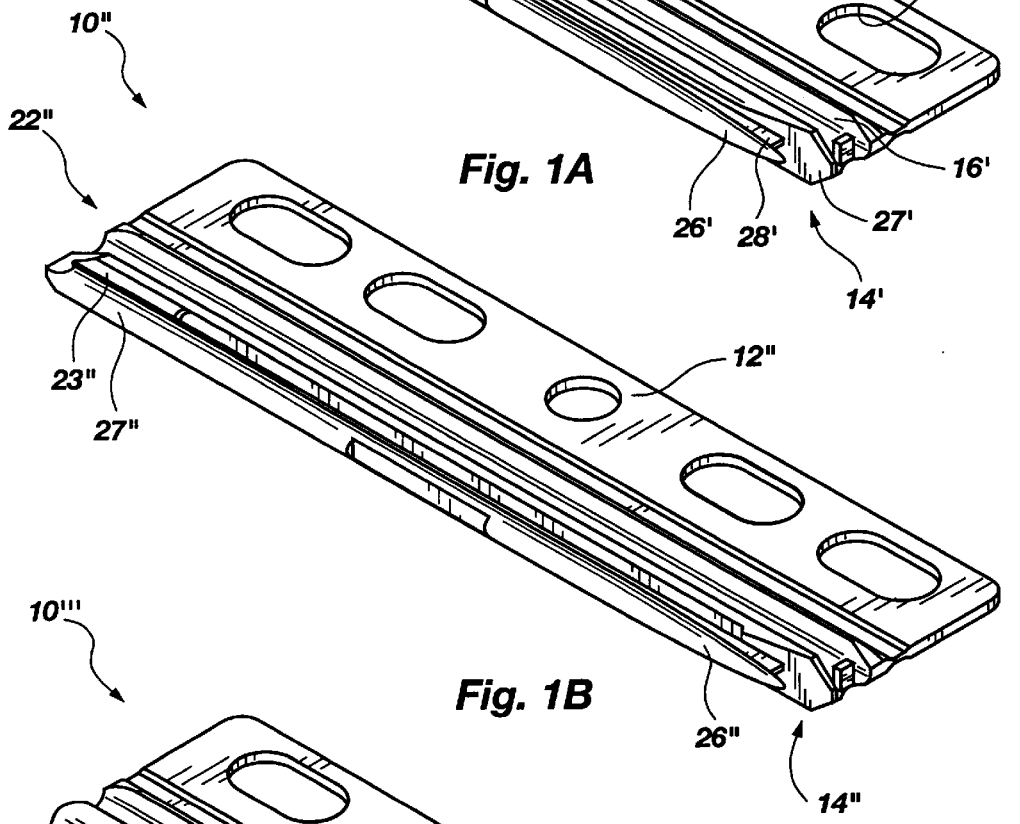
FIG. 1B is a frontal perspective view of a third embodiment of the attachment apparatus of the present invention, depicting a variation of the engaging member thereof.
Figure 2A:
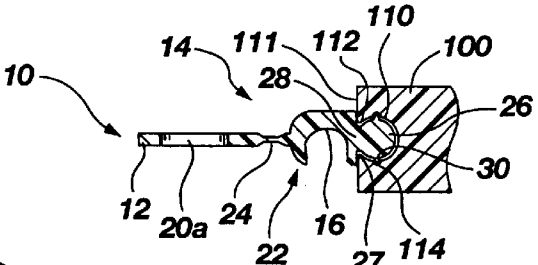
FIG. 2A is a cross-section taken along line 2A—2A of FIG. 2.

Referring to FIG. 1B, a second embodiment of an attachment apparatus 10" according to the present invention is illustrated. Securing element 14" of attachment apparatus 10" includes a connecting member 22" with a neck region 23" that secures to or is continuous with only a top portion 27" of the engaging member 26" of securing element 14". The thickness and any features of connecting member 22" may be configured similarly to those of connecting member 22 in the previously described embodiment of attachment apparatus 10. The engaging member 26" of securing element 14" may likewise be configured similarly to engaging member 26 of the previously described embodiment of attachment apparatus 10'.

Figure 1C:
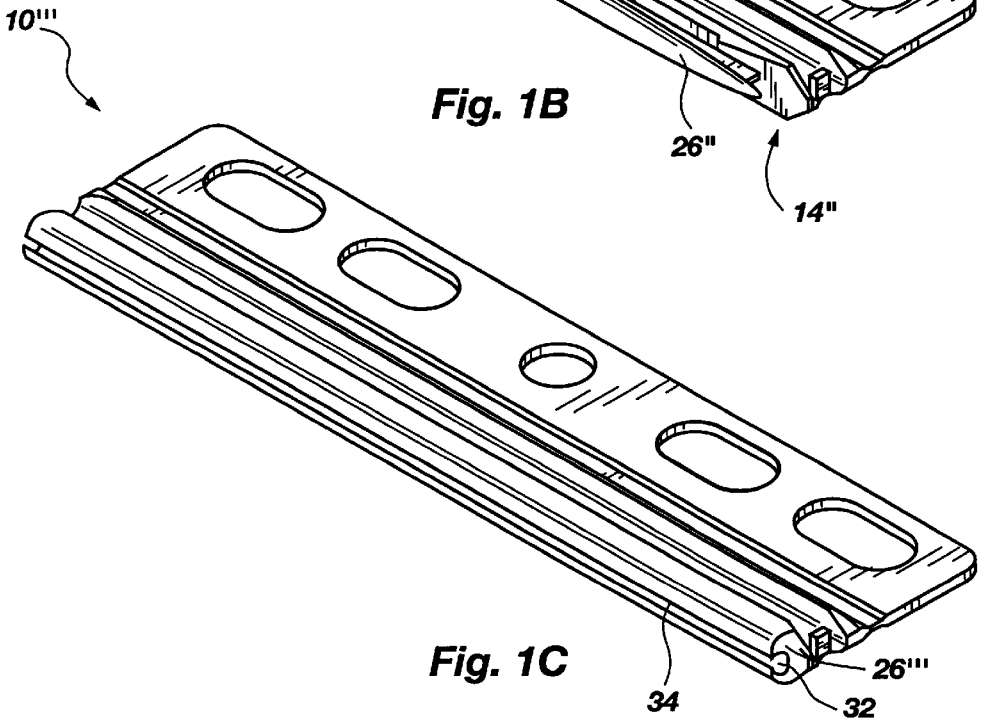
FIG. 1C is a frontal perspective view of a fourth embodiment of the attachment apparatus of the present invention, depicting another variation of the engaging member thereof.

FIG. 1C shows a third embodiment of attachment apparatus 10'", in which engaging member 26'" comprises a receptacle 32 and an elongated slot 34 adjacent thereto and continuous therewith. Receptacle 32 is configured to receive a corresponding, complementarily configured member (not shown) of an electronic device (not shown) to be secured to attachment apparatus 10'".

Of course, it is not necessary that engaging member 26 be elongated, so long as engaging member 26 is removably engageable with a corresponding member or feature of the electronic device to be mutually secured therewith. Accordingly, other configurations of engaging member 26 that may be removably engaged with a complementary feature of the electronic device are within the scope of the present invention. Exemplary configurations of engaging member 26 include, without limitation, spherical, hemispherical, conical, frustoconical, and other shapes.

Turning again to FIGS. 1, 1D, and 3–8, attachment apparatus 10 may also include an accessory receptacle 16. Preferably, accessory receptacle 16 is disposed on or adjacent connecting member 22. Accessory receptacle 16 may be configured to receive an accessory of the electronic device to be secured to attachment apparatus 10 or any other accessory that may be desirably secured to attachment apparatus 10. As illustrated, accessory receptacle 16 is configured to have a substantially cylindrical shape.

Figure 7:
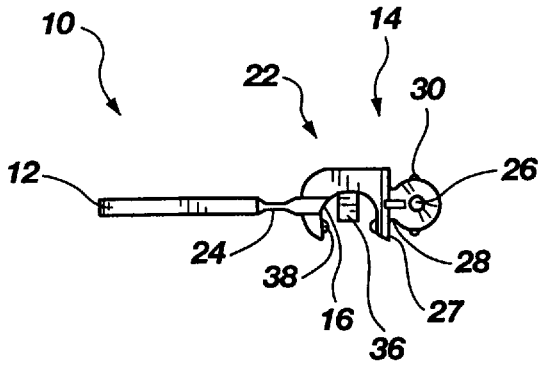
FIG. 7 is an elevational plan view of a bottom peripheral edge of the attachment apparatus shown in FIG. 1.
Figure 8:
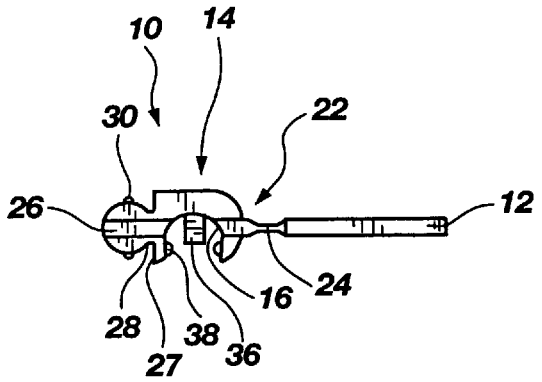
FIG. 8 is an elevational plan view of a top peripheral edge of the attachment apparatus shown in FIG. 1.

With reference to FIGS. 4 and 7, a stopper 36 may be disposed within or adjacent accessory receptacle 16 so as to prevent an accessory that is engaged by accessory receptacle 16 from becoming dislocated therefrom and, thus, from becoming dislocated from attachment apparatus 10. As illustrated in FIGS. 3 and 8, stopper 36 includes a protrusion that at least partially blocks an end of a substantially cylindrical accessory receptacle 16. Alternatively, stopper 36 may completely block an end of accessory receptacle 16. As another alternative, stopper 36 may be removably disposable over an end of accessory receptacle 16, such as by use of a hinge or snap-type configuration.

With reference to FIG. 8, accessory receptacle 16 may also include protrusions, indents, or another type of securing feature 38, such as those described above in reference to engaging member 26, which are configured and positioned to mutually and somewhat resiliently engage complementary features of an accessory to be received by accessory receptacle 16. Accordingly, one or more such securing features 38 enhance the retention of an accessory within accessory receptacle 16.

Figures 10A, 10B:
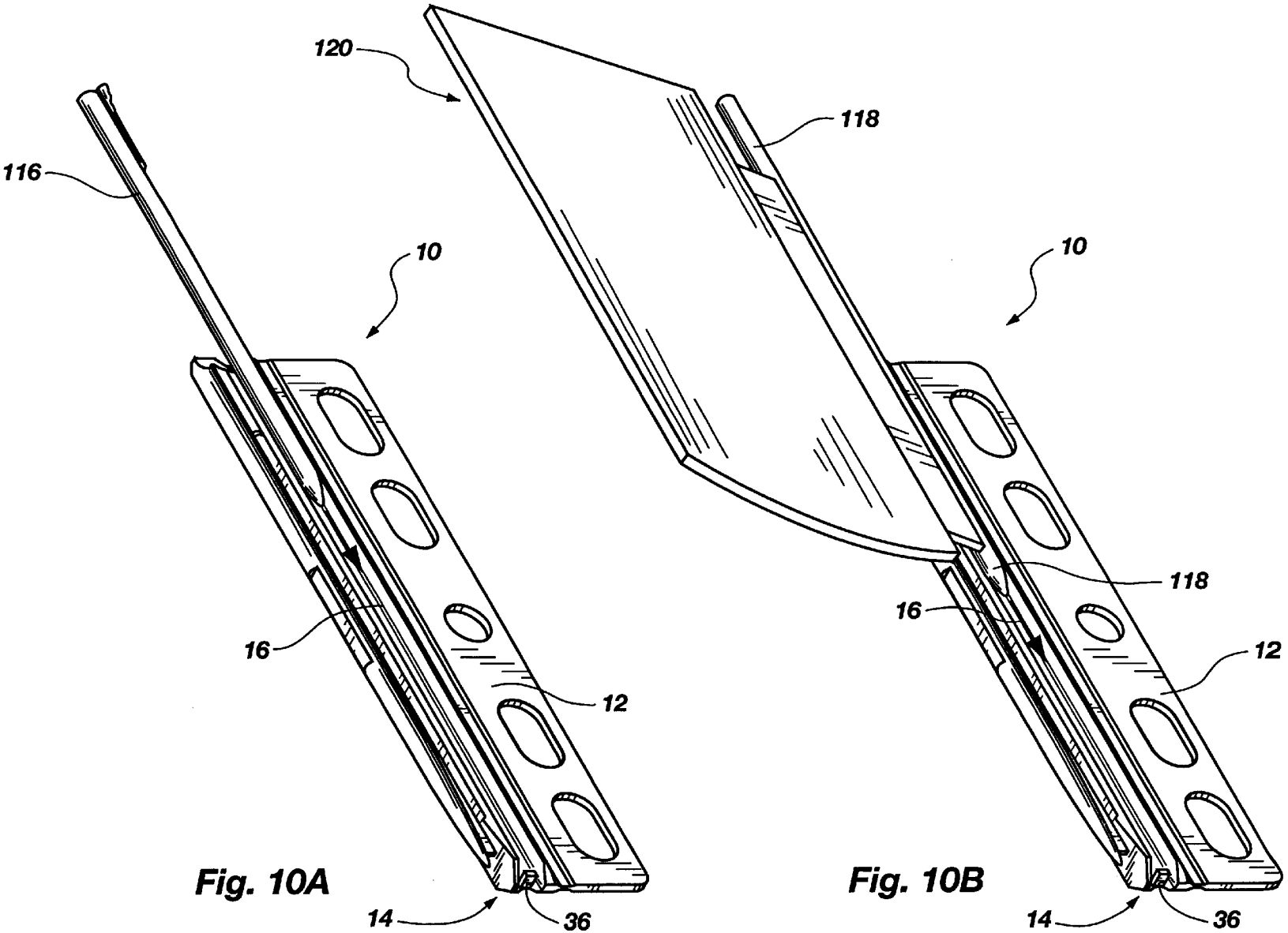
FIG. 10A is a frontal perspective assembly view of a first accessory, a stylus pen, being received by an accessory receptacle of the attachment apparatus of FIG. 1.
FIG. 10B is a frontal perspective assembly view of a second accessory, a hinge of a protective cover, being received by an accessory receptacle of the attachment apparatus of FIG. 1.

FIGS. 10A and 10B illustrate exemplary accessories of an electronic device being received by accessory receptacle 16. In FIG. 10A, the insertion of a stylus pen 116 into accessory receptacle 16 is shown. FIG. 10B depicts the accessory receptacle 16 receiving a hinge member 118 of a protective cover 120 for the electronic device.

Figure 2:
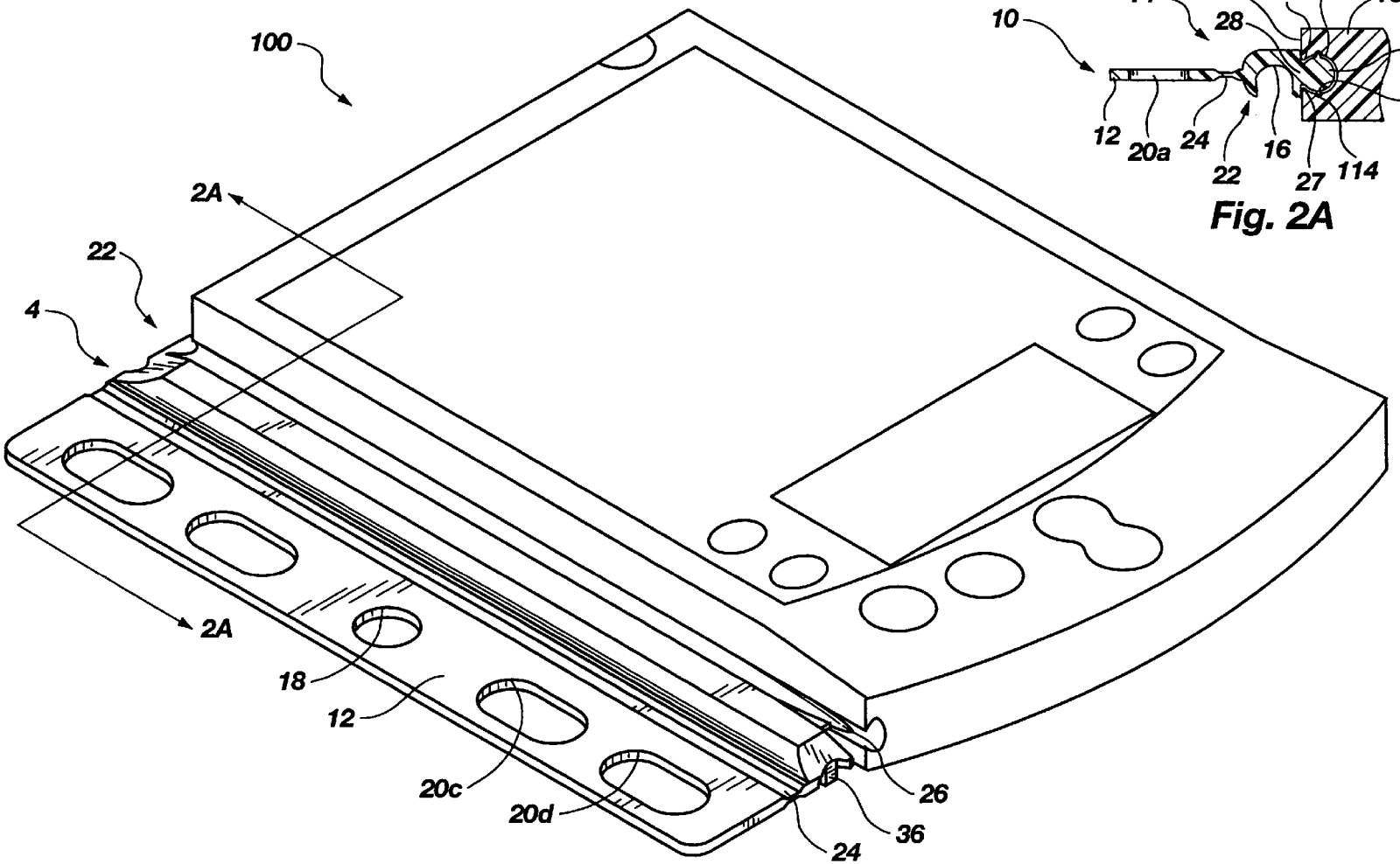
FIG. 2 is a schematic, frontal perspective view of an assembly according to the present invention, which includes the attachment apparatus shown in FIG. 1 and an electronic device secured thereto.

Referring now to FIGS. 2 and 2A, an assembly including attachment apparatus 10 and an electronic device 100 is illustrated. Engaging member 26 and region 28 of connecting member 22 are aligned with receptacle 110 and slot 112, respectively, of electronic device 100. As engaging member 26 is longitudinally inserted into and received by receptacle 110 and connecting member 24 is at least partially inserted into and received by slot 112, attachment apparatus 10 and electronic device 100 are secured to one another. Engaging member 26 may be further secured within slot 110 as protrusions 30 mutually engage corresponding indents 114 in receptacle 110. When engaging member 26 has been completely inserted into receptacle 110, a device abutment surface 27 of attachment apparatus 10 may be disposed against a corresponding surface of electronic device 100.

Attachment apparatus 10 may be similarly removed from electronic device 100 by disengaging protrusions 30 from their corresponding indents 114 and longitudinally removing engaging member 26 from receptacle 110.

As illustrated in FIGS. 10A and 10B, accessories 116, 120, respectively, may be secured to and removed from accessory receptacle 16 in a similar fashion to the securing of attachment apparatus 10 to electronic device 100 and removal of attachment apparatus 10 from electronic device 100 (see FIGS. 2 and 2A).

Figure 9:
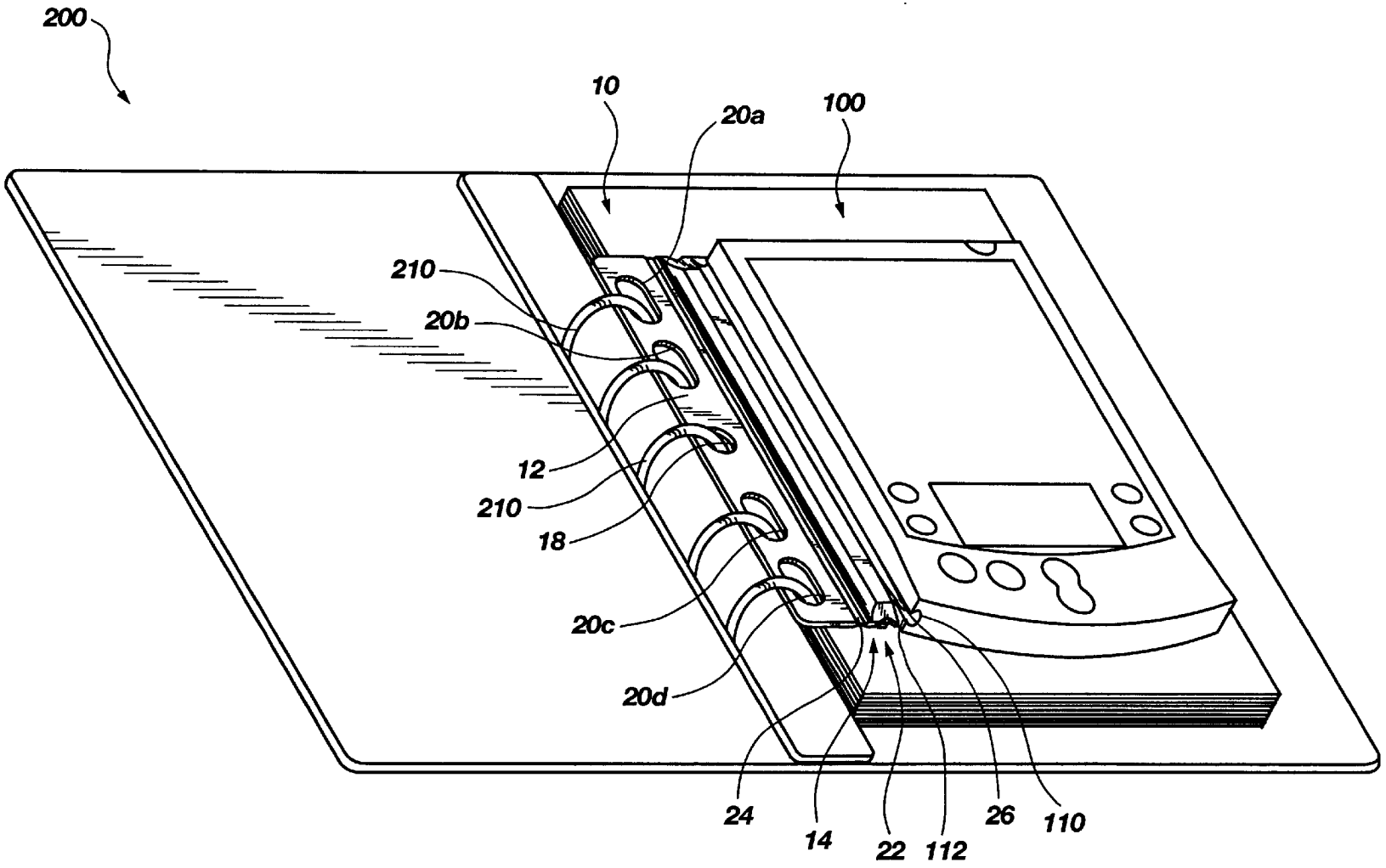
FIG. 9 is a schematic, frontal perspective view of the attachment apparatus shown in FIG. 1 attached to the retaining elements of a loose-leaf support assembly.

Referring now to FIG. 9, attachment apparatus 10 may be secured to the laterally spaced apart retaining elements 210 of a loose-leaf support assembly 200, such as the rings of a binder, by opening retaining elements 210 to facilitate the loose attachment of attachment apparatus 10 thereto, inserting one or more retaining elements 210 into corresponding apertures 18, 20*a*, 20*b*, etc. of attachment element 12, and closing retaining elements 210 to prevent the removal of attachment apparatus 10 from retaining elements 210. Accordingly, the present invention also includes an assembly of the attachment apparatus 10 according to the present invention, an electronic device 100 secured thereto, and the loose-leaf support assembly 200 to which attachment apparatus 10 is removably attached.

Although the foregoing description includes many specifics and examples, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions, and modifications to the invention as disclosed herein and which fall within the meaning of the claims are to be embraced within their scope.

What is claimed is:

1. An attachment apparatus for attaching an electronic device to at least one retaining element of a loose-leaf securing assembly, the attachment apparatus comprising:

an attachment element configured to be engaged by the at least one retaining element; and a securing element adjacent said attachment element and including:

a connecting member adjacent said attachment element; and an engaging member having a thickness greater than a thickness of an adjacent region of said connecting member and disposed adjacent said connecting member, opposite said attachment element, said engaging member configured to removably engage a corresponding feature of the electronic device.

2. The apparatus of claim 1, wherein said attachment element comprises a plurality of apertures therethrough, each configured to be engaged by at least one retaining element.

3. The apparatus of claim 2, wherein at least one of said plurality of apertures is substantially circular.

4. The apparatus of claim 2, wherein at least one of said plurality of apertures is elongate and extends along a length of said attachment element.

5. The apparatus of claim 1, wherein said engaging member is configured to be received by a complementarily configured receptacle of the electronic device.

6. The apparatus of claim 5, wherein, upon receipt of said engaging member by said receptacle, said adjacent region of said connecting member extends through a slot continuous with said receptacle.

7. The apparatus of claim 1, wherein said adjacent region of said connecting member extends substantially along a length of said engaging member.

8. The apparatus of claim 1, wherein said adjacent region of said connecting member extends only partially along a length of said engaging member.

9. The apparatus of claim 1, wherein said connecting member comprises a living hinge disposed adjacent said attachment element.

10. The apparatus of claim 1, wherein said attachment element, said connecting member, and said engaging member are arranged in a substantially mutually parallel relationship.

11. The apparatus of claim 1, wherein said engaging member is substantially cylindrically shaped.

12. The apparatus of claim 1, wherein said engaging member comprises a receptacle.

13. The apparatus of claim 12, wherein said receptacle is configured to receive a complementarily configured feature extending from a surface of the electronic device.

14. The apparatus of claim 1, further comprising an accessory receptacle disposed between said attachment element and said securing element.

15. The apparatus of claim 14, wherein said accessory receptacle is configured to receive an accessory of the electronic device.

16. The apparatus of claim 15, wherein said accessory comprises a stylus or a hinge of a removable protective cover for the electronic device.

17. The apparatus of claim 14, further comprising a stopper disposed along a pathway of said accessory receptacle.

18. An attachment apparatus for attaching an electronic device to at least one retaining element of a loose-leaf securing assembly, the attachment apparatus comprising:

an attachment element configured to be engaged by the at least one retaining element; and a securing element adjacent said attachment element and comprising:

a connecting member adjacent said attachment element; and an engaging member adjacent said connecting member, opposite said attachment element, and configured to engage a corresponding feature of the electronic device.

19. The apparatus of claim 18, wherein a region of said connecting member adjacent said engaging member is thinner than an adjacent region of said engaging member.

20. An electronic device assembly, comprising:

an attachment apparatus comprising:

an attachment element attachable to at least one retaining element of a loose-leaf support assembly; and a securing element adjacent said attachment element and including a connecting member adjacent said attachment element and an engaging member adjacent said connecting member, opposite said attachment element; and an electronic device secured to said engaging member.

21. The electronic device assembly of claim 20, further comprising a loose-leaf support assembly including at least one retaining element to which said attachment element is attached.

22. An assembly, comprising:

a loose-leaf support assembly having at least one retaining element;

an attachment apparatus comprising:

an attachment element attached to said at least one retaining element; and a securing element adjacent said attachment element and including a connecting member adjacent said attachment element and an engaging member adjacent said connecting member, opposite said attachment element; and an electronic device secured to said engaging member.

23. A method of securing an electronic device to a loose-leaf support assembly, comprising:

removably engaging a receptacle adjacent a peripheral edge of the electronic device with an engaging member of an attachment apparatus, said engaging member having a thickness greater than a thickness of an adjacent region of a connecting member positioned between said engaging member and an attachment element of said attachment apparatus; and attaching said attachment element to at least one retaining element of the loose-leaf support assembly to facilitate movement of said attachment apparatus along said at least one retaining element.

24. The method of claim 23, wherein said removably engaging comprises inserting said engaging member into said receptacle.

25. The method of claim 23, wherein said attaching comprises securing said at least one retaining element to an aperture formed through said attachment apparatus.

* * * * *

UNITED STATES PATENT AND TRADEMARK OFFICE

CERTIFICATE OF CORRECTION

PATENT NO. : 6,200,056 B1 
DATED : March 13, 2001
INVENTOR(S) : Cherell Jordin, Gary E. Hogge and Jeffery O. Brown It is certified that error appears in the above-identified patent and that said Letters Patent is hereby corrected as shown below:

Title page,
Item [56], References Cited, U.S. PATENT DOCUMENTS, after "5,597,256" delete "*"

Column 3,
Line 3, change "form" to -- from --

Column 7,
Line 54, change "second" to -- third --
Line 67, change "third" to -- fourth --

Column 8,
Line 66, after "surface" insert -- 111 --

Signed and Sealed this

Twenty-ninth Day of July, 2003

JAMES E. ROGAN
*Director of the United States Patent and Trademark Office*